US010148010B2

(12) United States Patent
Lahti et al.

(10) Patent No.: US 10,148,010 B2
(45) Date of Patent: Dec. 4, 2018

(54) ANTENNA ARRANGEMENT

(71) Applicant: Intel Corporation, Santa Clara, CA (US)

(72) Inventors: Saku Lahti, Tampere (FI); Mikko S. Komulainen, Tampere (FI)

(73) Assignee: Intel Corporation, Santa Clara, CA (US)

( * ) Notice: Subject to any disclaimer, the term of this patent is extended or adjusted under 35 U.S.C. 154(b) by 227 days.

(21) Appl. No.: 14/976,847

(22) Filed: Dec. 21, 2015

(65) Prior Publication Data

US 2017/0179590 A1 Jun. 22, 2017

(51) Int. Cl.
*H01Q 5/35* (2015.01)
*H01Q 7/00* (2006.01)

(52) U.S. Cl.
CPC ..... *H01Q 5/35* (2015.01); *H01Q 7/00* (2013.01)

(58) Field of Classification Search
CPC ..... H01Q 1/50; H01Q 1/243; H01Q 21/28; H01Q 9/045; H01Q 9/26; H01Q 9/065; H01Q 9/265; H01Q 9/285; H01Q 23/00; H01Q 19/13; H01Q 21/062; H01Q 21/0006
USPC ..... 343/858
See application file for complete search history.

(56) References Cited

U.S. PATENT DOCUMENTS

2008/0238568 A1* 10/2008 Davies-venn ..... H03H 7/42 333/25
2009/0039977 A1* 2/2009 Lee ..... H03H 7/42 333/25
2010/0277383 A1* 11/2010 Autti ..... H01Q 1/243 343/749
2014/0266506 A1* 9/2014 Andersson ..... H01F 27/42 333/177

* cited by examiner

*Primary Examiner* — Hoang Nguyen
*Assistant Examiner* — Awat Salih
(74) *Attorney, Agent, or Firm* — Eschweiler & Potashnik, LLC

(57) ABSTRACT

An antenna system includes an antenna having a symmetric geometry with respect to first and second antenna feed ports associated therewith, and a hybrid antenna feed circuit coupled to the first and second antenna feed ports of the antenna. The hybrid antenna feed circuit is configured to receive first and second transmit signals and feed the first transmit signal to the first and second antenna feed ports in a balanced feed mode and feed the second transmit signal to the first and second antenna feed ports in an unbalanced mode in a concurrent fashion.

7 Claims, 5 Drawing Sheets

Example UE

ANTENNA ARRANGEMENT

BACKGROUND

Future mobile communication platforms employ multiple radios to operate simultaneously, and thus modern mobile devices need several antennas to serve different radios included in the system. In many cases, for example, in the case of multiple-input, multiple-output (MIMO) operation, two antennas need to operate at the same frequencies without affecting each other. A typical solution is to locate antennas sufficiently far away from each other, however has several drawbacks, for example, increased requirements for antenna space and need for coaxial cables to feed the antennas.

DETAILED DESCRIPTION

Figure 1:
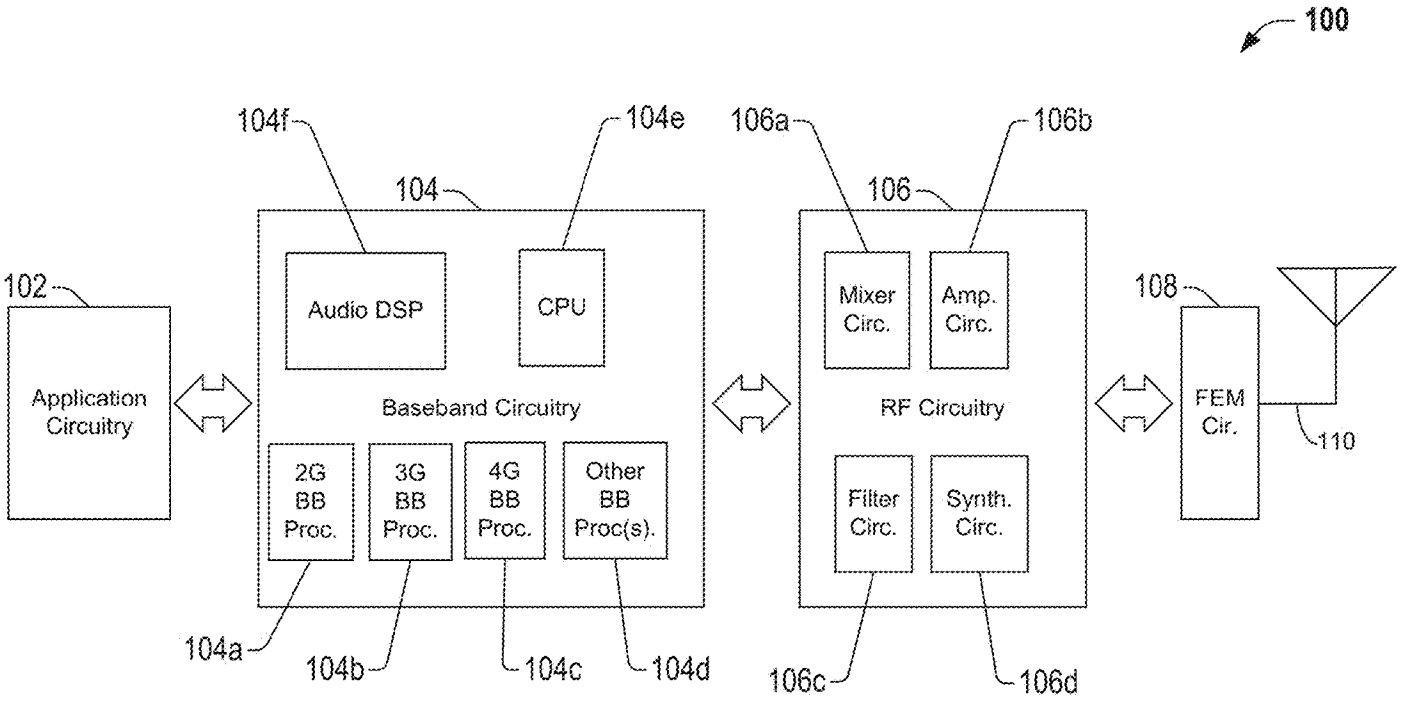
FIG. 1 is a block diagram illustrating a user equipment (UE) that may be used to incorporate an antenna system according to one embodiment of the disclosure.

A device and method are disclosed that are directed to an adaptive wireless receiver circuit and associated method in a wireless communication device such as a User Equipment (UE), for example.

The present disclosure will now be described with reference to the attached drawing figures, wherein like reference numerals are used to refer to like elements throughout, and wherein the illustrated structures and devices are not necessarily drawn to scale. As utilized herein, terms "component," "system," "interface," and the like are intended to refer to a computer-related entity, hardware, software (e.g., in execution), and/or firmware. For example, a component can be a processor (e.g., a microprocessor, a controller, or other processing device), a process running on a processor, a controller, an object, an executable, a program, a storage device, a computer, a tablet PC and/or a user equipment (e.g., mobile phone, etc.) with a processing device. By way of illustration, an application running on a server and the server can also be a component. One or more components can reside within a process, and a component can be localized on one computer and/or distributed between two or more computers. A set of elements or a set of other components can be described herein, in which the term "set" can be interpreted as "one or more."

Further, these components can execute from various computer readable storage media having various data structures stored thereon such as with a module, for example. The components can communicate via local and/or remote processes such as in accordance with a signal having one or more data packets (e.g., data from one component interacting with another component in a local system, distributed system, and/or across a network, such as, the Internet, a local area network, a wide area network, or similar network with other systems via the signal).

As another example, a component can be an apparatus with specific functionality provided by mechanical parts operated by electric or electronic circuitry, in which the electric or electronic circuitry can be operated by a software application or a firmware application executed by one or more processors. The one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

Use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. Furthermore, to the extent that the terms "including", "includes", "having", "has", "with", or variants thereof are used in either the detailed description and the claims, such terms are intended to be inclusive in a manner similar to the term "comprising."

As used herein, the term "circuitry" may refer to, be part of, or include an Application Specific Integrated Circuit (ASIC), an electronic circuit, a processor (shared, dedicated, or group), and/or memory (shared, dedicated, or group) that execute one or more software or firmware programs, a combinational logic circuit, and/or other suitable hardware components that provide the described functionality. In some embodiments, the circuitry may be implemented in, or functions associated with the circuitry may be implemented by, one or more software or firmware modules. In some embodiments, circuitry may include logic, at least partially operable in hardware.

Embodiments described herein may be implemented into a system using any suitably configured hardware and/or software. FIG. 1 illustrates, for one embodiment, example components of a User Equipment (UE) device 100. The UE may comprise a mobile telephone handset or other portable communication device. In some embodiments, the UE device 100 may include application circuitry 102, baseband circuitry 104, Radio Frequency (RF) circuitry 106, front-end module (FEM) circuitry 108 and one or more antennas 110, coupled together at least as shown.

The application circuitry 102 may include one or more application processors. For example, the application circuitry 102 may include circuitry such as, but not limited to, one or more single-core or multi-core processors. The processor(s) may include any combination of general-purpose processors and dedicated processors (e.g., graphics processors, application processors, etc.). The processors may be coupled with and/or may include memory/storage and may be configured to execute instructions stored in the memory/storage to enable various applications and/or operating systems to run on the system.

The baseband circuitry 104 may include circuitry such as, but not limited to, one or more single-core or multi-core processors. The baseband circuitry 104 may include one or more baseband processors and/or control logic to process baseband signals received from a receive signal path of the RF circuitry 106 and to generate baseband signals for a transmit signal path of the RF circuitry 106. Baseband processing circuitry 104 may interface with the application circuitry 102 for generation and processing of the baseband signals and for controlling operations of the RF circuitry 106. For example, in some embodiments, the baseband circuitry 104 may include a second generation (2G) baseband processor 104*a*, third generation (3G) baseband processor 104*b*, fourth generation (4G) baseband processor 104*c*, and/or other baseband processor(s) 104*d* for other existing generations, generations in development or to be developed in the future (e.g., fifth generation (5G), 6G, etc.). The baseband circuitry 104 (e.g., one or more of baseband processors 104*a-d*) may handle various radio control functions that enable communication with one or more radio networks via the RF circuitry 106. The radio control functions may include, but are not limited to, signal modulation/demodulation, encoding/decoding, radio frequency shifting, etc. In some embodiments, modulation/demodulation circuitry of the baseband circuitry 104 may include Fast-Fourier Transform (FFT), precoding, and/or constellation mapping/demapping functionality. In some embodiments, encoding/decoding circuitry of the baseband circuitry 104 may include convolution, tail-biting convolution, turbo, Viterbi, and/or Low Density Parity Check (LDPC) encoder/decoder functionality. Embodiments of modulation/demodulation and encoder/decoder functionality are not limited to these examples and may include other suitable functionality in other embodiments.

In some embodiments, the baseband circuitry 104 may include elements of a protocol stack such as, for example, elements of an evolved universal terrestrial radio access network (EUTRAN) protocol including, for example, physical (PHY), media access control (MAC), radio link control (RLC), packet data convergence protocol (PDCP), and/or radio resource control (RRC) elements. A central processing unit (CPU) 104*e* of the baseband circuitry 104 may be configured to run elements of the protocol stack for signaling of the PHY, MAC, RLC, PDCP and/or RRC layers. In some embodiments, the baseband circuitry may include one or more audio digital signal processor(s) (DSP) 104*f*. The audio DSP(s) 104*f* may be include elements for compression/decompression and echo cancellation and may include other suitable processing elements in other embodiments. Components of the baseband circuitry may be suitably combined in a single chip, a single chipset, or disposed on a same circuit board in some embodiments. In some embodiments, some or all of the constituent components of the baseband circuitry 104 and the application circuitry 102 may be implemented together such as, for example, on a system on a chip (SOC).

In some embodiments, the baseband circuitry 104 may provide for communication compatible with one or more radio technologies. For example, in some embodiments, the baseband circuitry 104 may support communication with an evolved universal terrestrial radio access network (EUTRAN) and/or other wireless metropolitan area networks (WMAN), a wireless local area network (WLAN), a wireless personal area network (WPAN). Embodiments in which the baseband circuitry 104 is configured to support radio communications of more than one wireless protocol may be referred to as multi-mode baseband circuitry.

RF circuitry 106 may enable communication with wireless networks using modulated electromagnetic radiation through a non-solid medium. In various embodiments, the RF circuitry 106 may include switches, filters, amplifiers, etc. to facilitate the communication with the wireless network. RF circuitry 106 may include a receive signal path which may include circuitry to down-convert RF signals received from the FEM circuitry 108 and provide baseband signals to the baseband circuitry 104. RF circuitry 106 may also include a transmit signal path which may include circuitry to up-convert baseband signals provided by the baseband circuitry 104 and provide RF output signals to the FEM circuitry 108 for transmission.

In some embodiments, the RF circuitry 106 may include a receive signal path and a transmit signal path. The receive signal path of the RF circuitry 106 may include mixer circuitry 106*a*, amplifier circuitry 106*b* and filter circuitry 106*c*. The transmit signal path of the RF circuitry 106 may include filter circuitry 106*c* and mixer circuitry 106*a*. RF circuitry 106 may also include synthesizer circuitry 106*d* for synthesizing a frequency for use by the mixer circuitry 106*a* of the receive signal path and the transmit signal path. In some embodiments, the mixer circuitry 106*a* of the receive signal path may be configured to down-convert RF signals received from the FEM circuitry 108 based on the synthesized frequency provided by synthesizer circuitry 106*d*. The amplifier circuitry 106*b* may be configured to amplify the down-converted signals and the filter circuitry 106*c* may be a low-pass filter (LPF) or band-pass filter (BPF) configured to remove unwanted signals from the down-converted signals to generate output baseband signals. Output baseband signals may be provided to the baseband circuitry 104 for further processing. In some embodiments, the output baseband signals may be zero-frequency baseband signals, although this is not a requirement. In some embodiments, mixer circuitry 106*a* of the receive signal path may comprise passive mixers, although the scope of the embodiments is not limited in this respect.

In some embodiments, the mixer circuitry 106*a* of the transmit signal path may be configured to up-convert input baseband signals based on the synthesized frequency provided by the synthesizer circuitry 106*d* to generate RF output signals for the FEM circuitry 108. The baseband signals may be provided by the baseband circuitry 104 and may be filtered by filter circuitry 106*c*. The filter circuitry 106*c* may include a low-pass filter (LPF), although the scope of the embodiments is not limited in this respect.

In some embodiments, the mixer circuitry 106*a* of the receive signal path and the mixer circuitry 106*a* of the transmit signal path may include two or more mixers and may be arranged for quadrature downconversion and/or upconversion respectively. In some embodiments, the mixer circuitry 106*a* of the receive signal path and the mixer circuitry 106*a* of the transmit signal path may include two or more mixers and may be arranged for image rejection (e.g., Hartley image rejection). In some embodiments, the mixer circuitry 106*a* of the receive signal path and the mixer circuitry 106*a* may be arranged for direct downconversion and/or direct upconversion, respectively. In some embodiments, the mixer circuitry 106*a* of the receive signal path and the mixer circuitry 106*a* of the transmit signal path may be configured for super-heterodyne operation.

In some embodiments, the output baseband signals and the input baseband signals may be analog baseband signals, although the scope of the embodiments is not limited in this respect. In some alternate embodiments, the output baseband signals and the input baseband signals may be digital baseband signals. In these alternate embodiments, the RF circuitry 106 may include analog-to-digital converter (ADC) and digital-to-analog converter (DAC) circuitry and the baseband circuitry 104 may include a digital baseband interface to communicate with the RF circuitry 106.

In some dual-mode embodiments, a separate radio IC circuitry may be provided for processing signals for each spectrum, although the scope of the embodiments is not limited in this respect.

In some embodiments, the synthesizer circuitry 106*d* may be a fractional-N synthesizer or a fractional N/N+1 synthesizer, although the scope of the embodiments is not limited in this respect as other types of frequency synthesizers may be suitable. For example, synthesizer circuitry 106*d* may be a delta-sigma synthesizer, a frequency multiplier, or a synthesizer comprising a phase-locked loop with a frequency divider.

The synthesizer circuitry 106*d* may be configured to synthesize an output frequency for use by the mixer circuitry 106*a* of the RF circuitry 106 based on a frequency input and a divider control input. In some embodiments, the synthesizer circuitry 106*d* may be a fractional N/N+1 synthesizer.

In some embodiments, frequency input may be provided by a voltage controlled oscillator (VCO), although that is not a requirement. Divider control input may be provided by either the baseband circuitry 104 or the applications processor 102 depending on the desired output frequency. In some embodiments, a divider control input (e.g., N) may be determined from a look-up table based on a channel indicated by the applications processor 102.

Synthesizer circuitry 106*d* of the RF circuitry 106 may include a divider, a delay-locked loop (DLL), a multiplexer and a phase accumulator. In some embodiments, the divider may be a dual modulus divider (DMD) and the phase accumulator may be a digital phase accumulator (DPA). In some embodiments, the DMD may be configured to divide the input signal by either N or N+1 (e.g., based on a carry out) to provide a fractional division ratio. In some example embodiments, the DLL may include a set of cascaded, tunable, delay elements, a phase detector, a charge pump and a D-type flip-flop. In these embodiments, the delay elements may be configured to break a VCO period up into Nd equal packets of phase, where Nd is the number of delay elements in the delay line. In this way, the DLL provides negative feedback to help ensure that the total delay through the delay line is one VCO cycle.

In some embodiments, synthesizer circuitry 106*d* may be configured to generate a carrier frequency as the output frequency, while in other embodiments, the output frequency may be a multiple of the carrier frequency (e.g., twice the carrier frequency, four times the carrier frequency) and used in conjunction with quadrature generator and divider circuitry to generate multiple signals at the carrier frequency with multiple different phases with respect to each other. In some embodiments, the output frequency may be a LO frequency (fLO). In some embodiments, the RF circuitry 106 may include an IQ/polar converter.

FEM circuitry 108 may include a receive signal path which may include circuitry configured to operate on RF signals received from one or more antennas 110, amplify the received signals and provide the amplified versions of the received signals to the RF circuitry 106 for further processing. FEM circuitry 108 may also include a transmit signal path which may include circuitry configured to amplify signals for transmission provided by the RF circuitry 106 for transmission by one or more of the one or more antennas 110.

In some embodiments, the FEM circuitry 108 may include a TX/RX switch to switch between transmit mode and receive mode operation. The FEM circuitry may include a receive signal path and a transmit signal path. The receive signal path of the FEM circuitry may include a low-noise amplifier (LNA) to amplify received RF signals and provide the amplified received RF signals as an output (e.g., to the RF circuitry 106). The transmit signal path of the FEM circuitry 108 may include a power amplifier (PA) to amplify input RF signals (e.g., provided by RF circuitry 106), and one or more filters to generate RF signals for subsequent transmission (e.g., by one or more of the one or more antennas 110.

In some embodiments, the UE device 100 may include additional elements such as, for example, memory/storage, display, camera, sensor, and/or input/output (I/O) interface.

Future wireless communication platforms require multiple radios to operate simultaneously, creating co-existence issues. For example, a Wi-Fi receiver co-existing with an LTE transmitter needs to handle the LTE blocker and hence needs high linearity to ensure the receiver is not saturated, which comes at a cost of high receiver power. A traditional solution to the co-existence issue employs a static high linearity receiver, which means the Wi-Fi receiver, in this example, will always consume high power, even when the LTE blocker is not present. In the present disclosure, a real-time blocker adaptive receiver is disclosed that is configured to sense blocker strength and dynamically adapt the receiver to save power when a blocker is not present.

Conventional narrowband receiver circuits require multiple off-chip passive filters, which increase receiver cost. According to one embodiment of the disclosure, a braodband receier is disclosed that can cover multiple frequency bands (e.g., 0.5 GHz-3.8 GHz) and does not require expensive passive external filters.

In one embodiment of the disclosure an antenna system is disclosed that uses a single antenna structure to operate as two antennas concurrently by feeding the antenna structure concurrently in a balanced and unbalanced mode of operation. Such an antenna system allows for an operation of two fully independent antennas operating at the same frequency using the same single antenna structure. Such an antenna system may be advantageously deployed in MIMO or other systems when multiple antennas need to operate at the same frequency simultaneously as such an antenna system does not need any physical separation distance between such antennas, as was needed in conventional systems.

In one embodiment the single antenna structure comprises an antenna geometry that is symmetric with respect to first and second antenna feed ports, as will be more fully appreciated infra. The antenna system further comprises an antenna feed circuit that feeds a first transmit signal to the first and second antenna feed ports in a balanced fashion and that concurrently feeds a second, different transmit signal to the first and second antenna feed ports in an unbalanced fashion.

Figure 2:
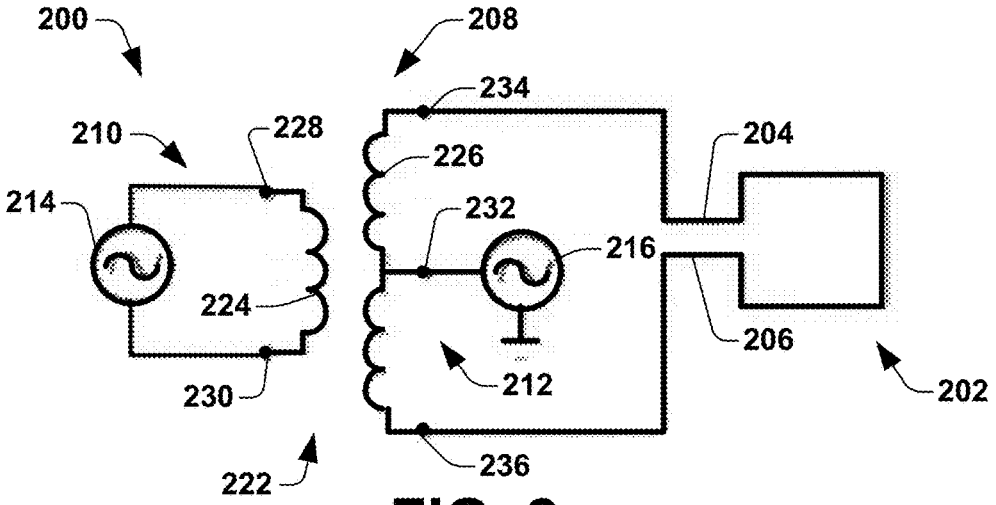
FIG. 2 is a schematic diagram illustrating an antenna system having an antenna and an antenna feed circuit according to one embodiment of the disclosure.

Turning to FIG. 2, an antenna system 200 is illustrated according to one embodiment of the disclosure. The antenna system 200 comprises an antenna structure 202 having first and second antenna feed ports 204, 206 coupled to an antenna feed circuit 208. In one embodiment the antenna feed circuit 208 comprises a balanced feed portion circuit 210 and an unbalanced feed portion circuit 212. In one embodiment the balanced feed portion circuit 210 receives a first transmit signal 214 and applies the first transmit signal 214 to the first and second antenna feed ports 204, 206 in a balanced fashion, wherein the first transmit signal 214 is applied to first and second antenna feed ports such that a phase difference of 180° exists between the ports 204, 206. Further, the unbalanced feed portion circuit 212 receives a second, different transmit signal 216 and applies the second transmit signal 216 to the first and second antenna feed ports 204, 206 in an unbalanced fashion, wherein the second transmit signal 216 is applied to the first and second antenna feed ports such that a phase different of 0° exists therebetween.

It should be understood that in one embodiment the balanced and unbalanced feed modes are able to achieve a desired phase difference of 180° and 0°, respectively. Alternatively, it should be appreciated that by referring to balanced and unbalanced feed modes that the present disclosure contemplates phase relationships between the signals at the first and second antenna feed ports to be sufficiently close to ideal as to transmit data successfully. In such instances a balanced feed mode may be substantially close to 180°, such as, for example, a 175°-185° phase relationship between the signals at the first and second antenna feed ports. Further, an unbalanced feed mode may be substantially close to 0°, such as, for example, −5° to 5° phase relationship between the signals at the first and second antenna feed ports In one embodiment the antenna feed circuit 208 can be considered a hybrid type antenna feed circuit in that it receives first and second transmit signals and feeds the first transmit signal to the first and second antenna feed ports in a balanced mode while it concurrently feeds the second transmit signal to the first and second antenna feed ports of the same antenna structure in an unbalanced mode.

Figure 3:
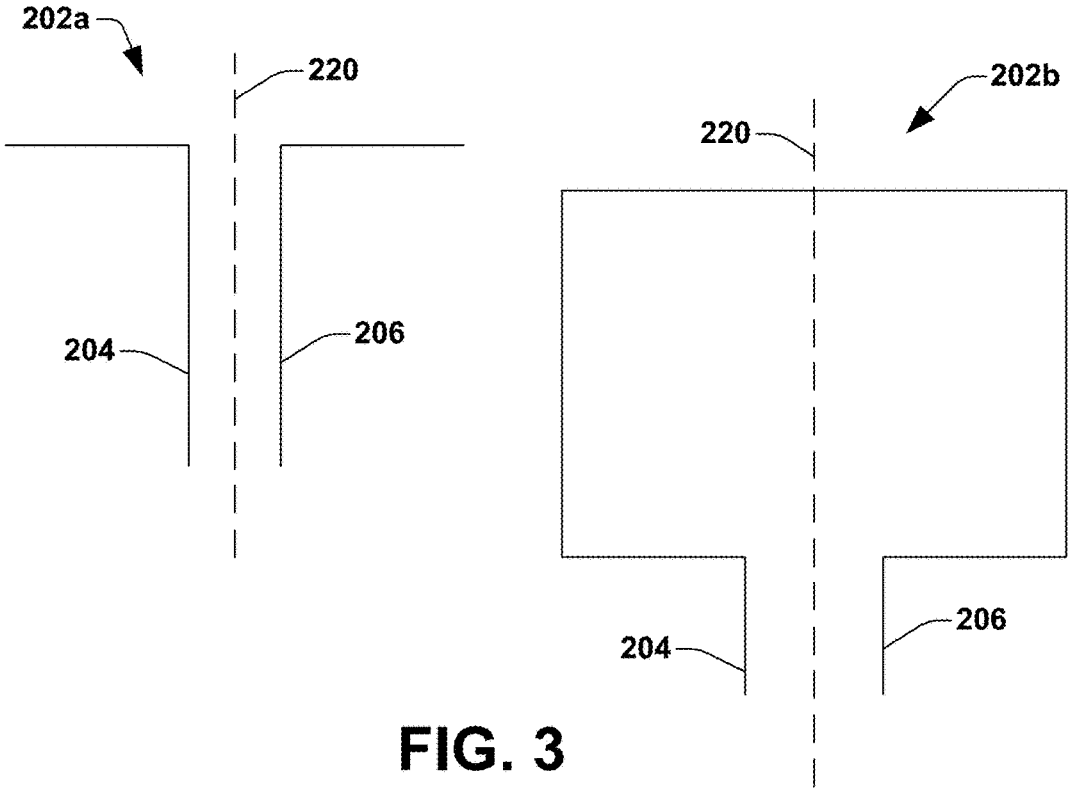
FIG. 3 is a diagram illustrating two example antenna structures that exhibit a geometry having a symmetry with respect to first and second antenna feed ports associated therewith according to one embodiment of the disclosure.

Still referring to FIG. 2, the antenna 202 of the antenna system 200 comprises a symmetric structure. The antenna 202 is a symmetric structure when it has a geometry of its radiating element(s) that exhibits a spatial symmetry about its respective first and second antenna feed ports. For example, as illustrated in FIG. 3, a first antenna structure 202*a* is a dipole antenna structure, wherein an axis 220 exists with respect to the antenna feed ports 204, 206 associated therewith. As can be seen in the figure, the dipole antenna structure 202*a* exhibits symmetry about the axis 220, wherein each side is a spatial mirror image of the other. Similarly, FIG. 3 also shows a second antenna structure 202*b* that is a loop antenna. As seen in the figure, the loop antenna structure 202*b* has an axis 220 with respect to the first and second antenna feed ports 204, 206, wherein the loop antenna 202*b* is spatially symmetric about the axis 220. Further, as will be appreciated, an infinite number of symmetric geometries can be generated that exhibit a symmetry with respect to the first and second antenna feed ports and all such alternative symmetric antenna structures are contemplated as falling within the scope of the present disclosure.

In operation, the antenna feed circuit 208 of FIG. 2 includes a transformer 222 having a first winding 224 and a second winding 226. The first winding 224 has first and second terminals 228, 230 that couple to an input port configured to receive an incoming differential transmit signal such as the first transmit signal 214 of FIG. 2. In one embodiment the differential signal has a positive portion coupled to the first terminal 228 and a negative portion coupled to the second terminal 230. In another embodiment, the first transmit signal 214 may be a single-ended transmit signal which is then converted to a differential signal. The first transmit signal 214 gets amplified from the first winding 224 to the second winding 226 of the transformer 222 with a gain based on the turns ratio $N_2/N_1$ of the transformer 222. With a ratio of 1:1 (same number of turns in the windings) in one embodiment the first transmit signal is delivered to the antenna feed ports 204, 206 of the antenna 202 due to the inductive coupling of the windings. As the first transmit signal 214 is still a differential signal, a phase difference of the signal at the antenna feed ports 204, 206 is 180° to provide for a balanced mode feed.

Still referring to FIG. 2, the second transmit signal 216 in this embodiment is a single-ended signal and is input to a center tap 232 of the second winding 226, which itself has first and second terminals 234, 236. The center tap 232 separates the second winding 226 into a first portion and a second portion, wherein a number of turns of the first and second portions are the same. With the second transmit signal 216 applied to the center tap, the same second transmit signal exists (is delivered) to the antenna feed ports 204, 206. That is, a phase difference of the second transmit signal 216 at the first and second antenna feed ports is 0°. With the two signals 214 and 216 operating in balanced and unbalanced modes, respectively, due to the antenna feed circuit, the second transmit signal 216 is at a point where the differential first transmit signal completely cancels itself out, thereby allowing for the two signals to be transmitted by the same antenna structure 202 at the same frequency, as if operating by two separate antenna structures. Therefore one can more fully appreciate that the antenna structure 202 needs to be symmetric to obtain the full advantages of the antenna system 200.

Figure 4:
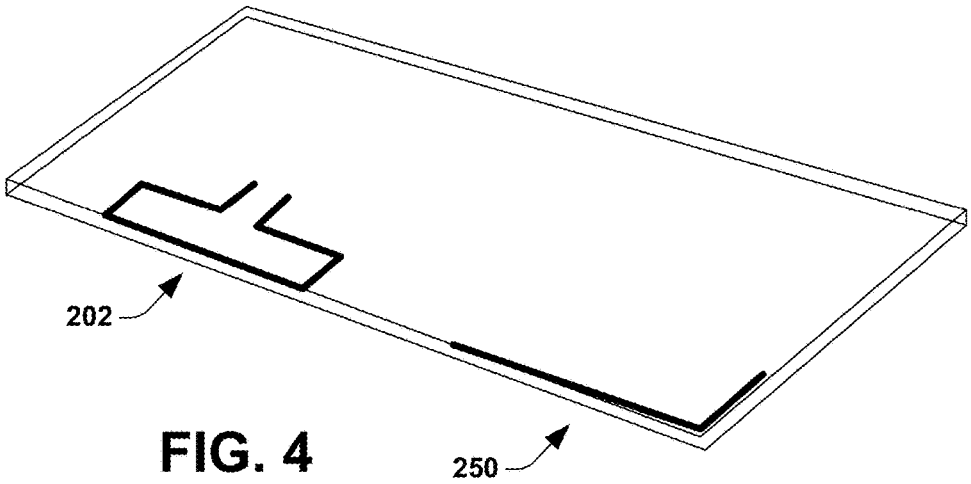
FIG. 4 is a diagram illustrating a space utilization comparison of an antenna structure that may employed in the present disclosure compared to a monopole antenna structure not having a requisite symmetry.

FIG. 4 is a perspective view of a symmetric antenna structure 202 in accordance with one embodiment compared to a non-symmetric monopole antenna structure 250. Due to the symmetry (as will be more fully appreciated infra), the symmetric antenna 202 when driven by an antenna feed circuit such as 208 of FIG. 2, can operate as two independent antennas with just the single antenna structure as a radiating element, while the monopole structure 250 would require a similar, additional antenna to operate as two independent antennas. The need for two structures as opposed to one, as well as the needed separation distance between the antenna structures makes the single antenna system 200 of the present disclosure advantageously compact.

Figure 5:
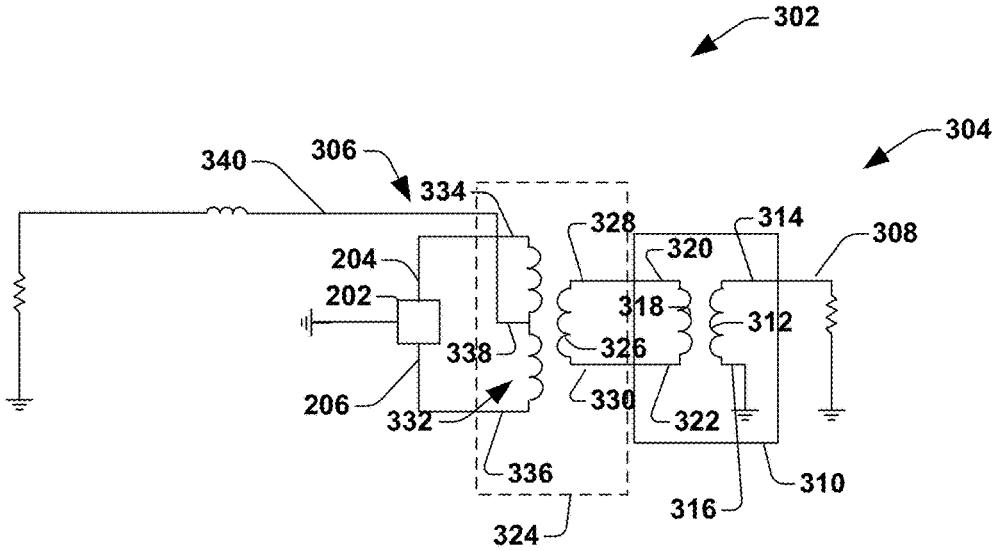
FIG. 5 is a schematic diagram illustrating an antenna feed circuit having a balanced feed portion and an unbalanced feed portion employing a transformer according to one embodiment of the disclosure.

FIG. 5 is a schematic diagram illustrating an antenna feed circuit 302 in greater detail according to one embodiment of the disclosure. The antenna feed circuit 302 may comprise a balanced feed portion circuit 304 and an unbalanced feed portion circuit 306. In the embodiment of FIG. 5, the first transmit signal 308 is a single-ended signal and thus a balun transformer circuit 310 is included that operates to convert the single-ended first transmit signal 308 to a differential signal to establish the balanced feed. In one embodiment, the balun transformer circuit 310 comprises a first winding 312 having first and second terminals 314, 316 and a second winding 318 having first and second terminals 320, 322. As shown in FIG. 5, the first terminal 314 of the first winding 312 is coupled to an input port that is configured to receive the single-ended first transmit signal 308, and the second terminal 316 of the first winding 312 is coupled to a predetermined reference potential such as ground.

The antenna feed circuit 302 further comprises a main transformer 324 having a first winding 326 having first and second terminals 328, 330 that are coupled to the first and second terminals 320, 322 of the second winding 318 of the balun transformer circuit 310. As can be seen in the figure, the first transmit signal 308 inductively couples to the main transformer via the second winding of the balun transformer circuit 310, and the first transmit signal 308 is now a differential signal. The main transformer 324 further comprises a second winding 332 having first and second terminals 334, 336 that are coupled to the first and second antenna feed ports 204, 206 of the antenna structure 202. The first transmit signal 308 in its differential form is inductively coupled from the first winding 326 to the second winding 332 of the main transformer 324 and is thereby fed to the antenna feed ports 204, 206 in a balanced mode wherein a phase difference of the first transmit signal 308 at the antenna feed ports 204, 206 is 180°.

The second winding 332 of the main transformer 324 also includes a center tap 338 that separates the second winding into two portions, the first and second portions, wherein a number of turns of the first and second portions are the same. The second transmit signal 340 is a single-ended signal and is received by the antenna feed circuit 302 at the center tap 338. Because the number of turns of the first and second portion of the second winding 332 are the same, the second transmit signal 340 is fed to the first and second antenna feed ports 204, 206 in an unbalanced fashion, wherein a phase shift of the second transmit signal 340 at the antenna feed ports 204, 206 is 0°.

Figure 6:
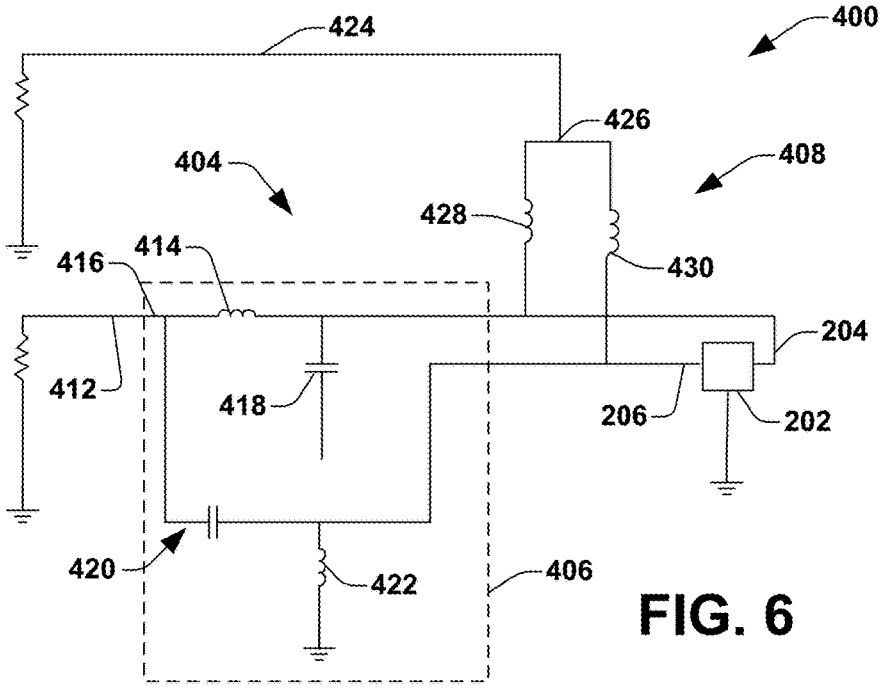
FIG. 6 is a schematic diagram illustrating an antenna feed circuit having a balanced feed portion and an unbalanced feed portion employing lumped components without a transformer according to one embodiment of the disclosure.

FIG. 6 is a schematic diagram illustrating an antenna system 400 according to another embodiment of the disclosure. The antenna system 400 includes the symmetric antenna structure 202 and an antenna feed circuit 404 using normal lumped components rather than one or more transformers as illustrated in FIGS. 2 and 5. The antenna feed circuit 404 comprises a balanced feed portion circuit 406 and an unbalanced feed portion circuit 408. As highlighted previously, as most transmit signals are single-ended, the balanced feed portion circuit 406 operates to receive a single-ended first transmit signal 412 and convert it to a differential signal having positive and negative signal portions such that at the antenna feed ports 204, 206 the first transmit signal is a balanced feed, wherein a phase shift is 180° therebetween.

In one embodiment the balanced feed portion circuit 406 comprises a first balun inductor 414 coupled between an input port 416 configured to receive the first transmit signal 412 and the first antenna feed port, and a first balun capacitor 418 coupled between the first antenna feed port 204 and a predetermined reference potential such as ground. Still referring to FIG. 6, the balanced feed portion circuit 406 (which can also be referred to as a balun transformer type circuit) has a second balun capacitor 420 coupled between the input port 416 and the second antenna feed port 206, and a second balun inductor 422 coupled between the second antenna feed port 206 and the predetermined reference potential. The balanced feed portion circuit 406 operates to convert the single-ended first transmit signal 412 to a differential signal and feed the differential first transmit signal to the first and second antenna feed ports 204, 206 in a balanced fashion.

The antenna feed circuit 404 further includes an unbalanced feed portion circuit 408 that receives a single-ended second transmit signal 424 at an input port 426 and feeds the second transmit signal 424 to the first and second antenna feed port 204, 206 in an unbalanced fashion, wherein the phase shift of the second transmit signal to the first and second antenna feed ports 204, 206 is 0°. In one embodiment the unbalanced feed portion circuit 408 comprise first and second inductors 428, 430 coupled between the second input port 426 and the first and second antenna feed ports, respectively.

Figure 7:
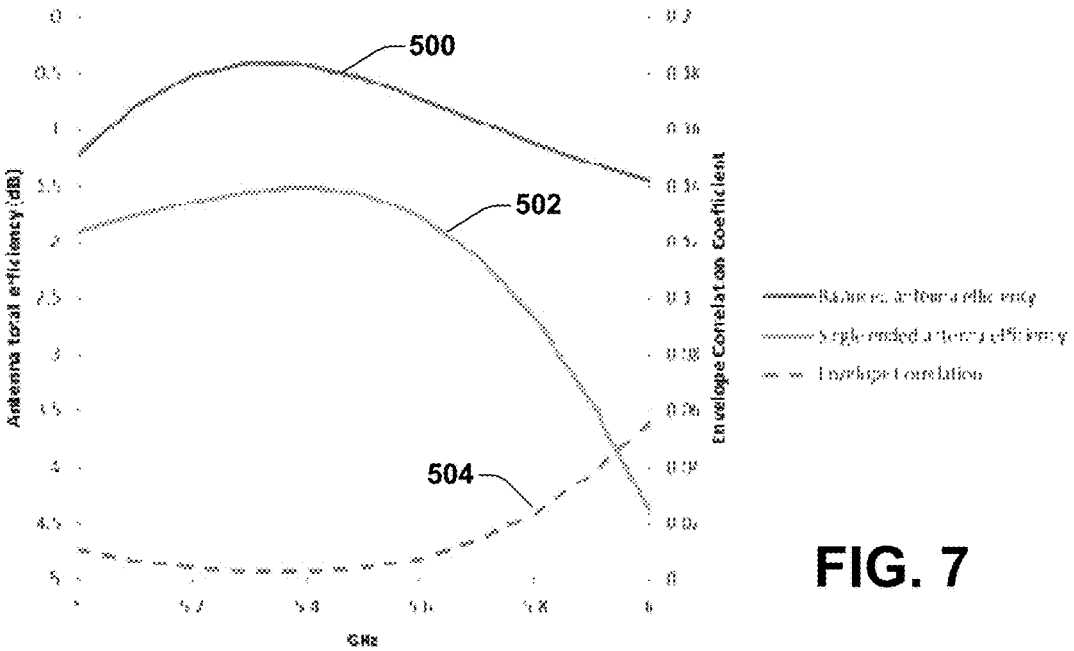
FIG. 7 is a graph illustrating an efficiency and a correlation figure of merit (FOM) of the antenna system according to one embodiment of the disclosure.

FIG. 7 is a graph that illustrates the efficiency of the symmetric antenna design using the antenna feed circuit of FIG. 6 according to one embodiment. As can be seen in the traces 500 and 502, the total antenna efficiency (measured in dB and scaled on the left) driven bin the balanced and unbalanced modes is good for a bandwidth of interest (e.g., 5 GHz). It is not until frequencies above 5.6 GHz that the efficiency in the unbalanced feed 502 begins to fall off. FIG. 7 further show a figure of merit (FOM) referred to as envelope correlation coefficient at 504. This is a FOM sometimes used in MIMO designs to characterize to what extent the operation of one antenna affects the other. As can be seen at 504, the correlation coefficient (scale on the right) is quite low, which indicates that the single antenna structure 202 operates as two independent antennas at a same frequency with very little effect on each other. Typically an envelope correlation coefficient of less than about 0.5 is considered acceptable, and as can be seen in FIG. 7 the correlation coefficient at 504 is well below 0.1 which is considered excellent.

Figure 8:
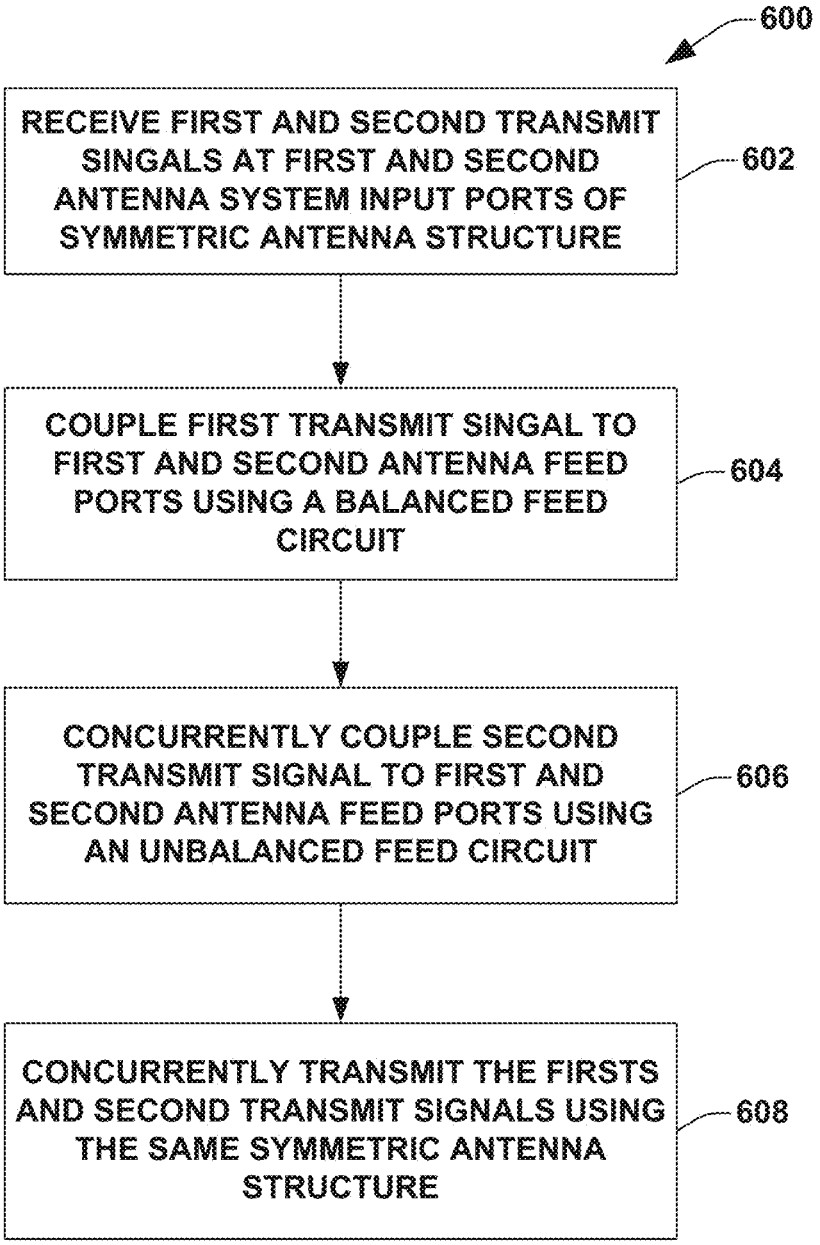
FIG. 8 is a flow chart illustrating a method of operating an antenna system according to one embodiment of the disclosure.

FIG. 8 is a flow chart illustrating a method 600 of operating an antenna system. While the method provided herein is illustrated and described as a series of acts or events, the present disclosure is not limited by the illustrated ordering of such acts or events. For example, some acts may occur in different orders and/or concurrently with other acts or events apart from those illustrated and/or described herein. In addition, not all illustrated acts are required and the waveform shapes are merely illustrative and other waveforms may vary significantly from those illustrated. Further, one or more of the acts depicted herein may be carried out in one or more separate acts or phases.

The method 600 begins at 602, and comprises receiving first and second transmit signals at first and second antenna system input ports of a symmetric antenna structure at 602. In one embodiment the first and second transmit signals are received at the same time and are at the same frequency, however, the first and second transmit signals may be at different frequencies and such alternatives are contemplated as falling within the scope of the present disclosure. The method 600 continues at 604, wherein the first transmit signal is coupled to the first and second antenna feed ports of the symmetric antenna structure using a balance feed circuit (e.g., using one of the balanced feed circuits described herein). In one embodiment the first transmit signal is a differential signal and the balanced feed circuit feeds the differential first transmit signal to the first and second antenna feed ports in a manner to ensure a 180 phase difference at the ports. In one embodiment the first transmit signal is a single-ended first transmit signal to a differential signal (e.g., using the balun transformer circuit described herein) and then feeding the converted differential first transmit signal to the first and second antenna feed ports in a balanced fashion that establishes the 180° phase difference at the antenna fee ports.

The method 600 continue sat 606 by concurrently coupling a second transmit signal to the first and second antenna feed ports using an unbalanced feed circuit. The unbalanced feed circuit receives the second transmit signal in its single-ended form and applies it to the first and second antenna feed ports to ensure a 0° phase difference between the antenna feed ports. The method 600 concludes at 608 by emitting the first and second transmit signals concurrently using the same symmetric antenna structure. As describe above, due to the symmetric geometry of the antenna structure and the feeding of the first and second transmit signals in a balanced and unbalanced fashion, respectively, the single antenna structure can transmit both signals independently of one another.

In an Example 1, an antenna system is disclosed and comprises an antenna comprising a first antenna fed port and a second antenna feed port associated therewith, and an antenna feed circuit. The antenna feed circuit comprises a balanced feed portion circuit configured to receive a first transmit signal and apply the first transmit signal to the first and second antenna feed ports in a balanced manner, and an unbalanced feed portion circuit configured to receive a second transmit signal and apply the second transmit signal to the first and second antenna feed ports in an unbalanced manner.

In an Example 2, in Example 1 the antenna comprises a symmetric antenna comprising a geometry that is spatially symmetric with respect to the first antenna fed port and the second antenna feed port associated therewith.

In an Example 3, in Examples 1 or 2, the antenna feed circuit is configured to feed the first transmit signal to both the first and second antenna feed ports with a phase difference therebetween of substantially 180° and concurrently feed the second transmit signal to both the first and second antenna feed ports with a phase difference therebetween of substantially 0°.

In an Example 4, in any of Examples 1-3, the balanced feed portion circuit of the antenna feed circuit comprises a transformer. The transformer comprises a first winding having a first terminal and a second terminal, wherein the first transmit signal comprises a differential signal having positive and negative signal portions, wherein the positive signal portion of the differential signal couples to the first terminal of the first winding, and the negative signal portion of the differential signal couples to the second terminal of the terminal of the first winding. The transformer further comprises a second winding having a first terminal and a second terminal, wherein the first terminal of the second winding is coupled to the first antenna feed port of the symmetric antenna, and the second terminal of the second winding is coupled to the second antenna feed port of the symmetric antenna, wherein the first winding and the second winding of the transformer are inductively coupled to one another.

In an Example 5, in Example 4 the second transmit signal is a single-ended transmit signal, and the second winding of the transformer comprises a center tap separating the second winding into a first portion and a second portion, wherein a number of turns of the first portion and the second portion of the second winding are the same. Further, the unbalanced feed portion circuit of the antenna feed circuit comprises an input port coupled to the center tap of the second winding, wherein the input port is configured to receive the second transmit signal.

In an Example 6, in any of Examples 1-3, the balanced feed portion circuit of the antenna feed circuit comprises a transformer that comprises a first winding having a first terminal and a second terminal, and a second winding having a first terminal and a second terminal. The first terminal of the second winding is coupled to the first antenna feed port of the symmetric antenna, and the second terminal of the second winding is coupled to the second antenna feed port of the symmetric antenna. Further, the first winding and the second winding of the transformer are inductively coupled to one another. The balanced feed portion circuit further comprises a balun transformer comprising first and second windings, wherein the second winding of the balun transformer comprises a first terminal coupled to the first terminal of the first winding of the transformer, and a second terminal coupled to the second terminal of the first winding of the transformer. The first winding of the balun transformer comprises a first terminal coupled to an input port configured to receive the first transmit signal, and a second terminal coupled to a predetermined reference potential, and the first transmit signal comprises a single-ended signal.

In an Example 7, in Example 6 the second transmit signal is a single-ended transmit signal, and the second winding of the transformer comprises a center tap separating the second winding into a first portion and a second portion, wherein a number of turns of the first portion and the second portion of the second winding are the same. The unbalanced feed portion circuit of the antenna feed circuit comprises an input port coupled to the center tap of the second winding, wherein the input port is configured to receive the second transmit signal.

In an Example 8, in any of Examples 1-3 the first and second transmit signals are single-ended signals, and the unbalanced feed portion circuit of the antenna feed circuit comprises a first inductor coupled between an input port configured to receive the second transmit signal and the first antenna feed port of the symmetric antenna, and a second inductor coupled between the first input port and the second antenna feed port of the symmetric antenna.

In an Example 9, in any of Examples 1-3, the first and second transmit signals are both single-ended signals, and the balanced feed portion circuit of the antenna feed circuit comprises a discrete balun transformer circuit having an input port configured to receive the first transmit signal, and first and second outputs coupled to the first and second antenna feed ports of the symmetric antenna, respectively. In addition, the discrete balun transformer circuit comprises passive circuit elements and no transformer.

In an Example 10, in Example 9 the discrete balun transformer circuit comprises a first balun inductor coupled between the input port and the first antenna feed port, and a first balun capacitor coupled between the first antenna feed port and a predetermined reference potential. In addition, the discrete balun transformer circuit further comprises a second balun capacitor coupled between the input port and the second antenna feed port, and a second balun inductor coupled between the second antenna feed port and the predetermined reference potential.

In an Example 11, a method of operating an antenna system is disclosed and comprises receiving a first transmit signal and a second transmit signal at first and second input ports of the antenna system, coupling the first transmit signal received at the first input port to first and second antenna feed ports of an antenna in a balanced coupling configuration using a balanced feed circuit, and coupling the second transmit signal received at the second input port to the first and second antenna feed ports of the antenna in an unbalanced coupling configuration using an unbalanced feed circuit. In the method the coupling of the first transmit signal and the second transmit signal to the first and second antenna feed ports is performed concurrently.

In an Example 12, in Example 11, the antenna comprises a symmetric antenna, wherein the symmetric antenna comprises a geometry that is spatially symmetric with respect to the first and second antenna feed ports.

In an Example 13, in Examples 11 or 12, coupling the first transmit signal to the first and second antenna feed ports in a balanced coupling configuration comprises establishing a 180° phase difference in the first transmit signal at the first and second antenna feed ports.

In an Example 14, in any of Examples 11-13 coupling the second transmit signal to the first and second antenna feed ports in an unbalanced coupling configuration comprises establishing a 0° phase difference in the second transmit signal at the first and second antenna feed ports.

In an Example 15, in any of Examples 11-13 coupling the first transmit signal to the first and second antenna feed ports in a balanced coupling configuration comprises coupling positive and negative portions of a differential form of the first transmit signal to first and second terminals of a first winding of a transformer, inductively coupling the differential first transmit signal from the first winding of the transformer to a second winding of the transformer, the second winding having first and second terminals, and coupling the first and second terminals of the second winding of the transformer to the first and second antenna feed ports, respectively, of the symmetric antenna.

In an Example 16, in Example 15 the method further comprises receiving the first transmit signal as a single-ended transmit signal, and converting the single-ended transmit signal to a differential first transmit signal having the positive and negative portions thereof using a balun transformer circuit.

In an Example 17, in Example 16 converting the single-ended first transmit signal to the differential first transmit signal using the balun transformer circuit comprises coupling the single-ended first transmit signal to a first terminal of a first winding of the balun transformer circuit, wherein a second terminal of the first winding of the balun transformer circuit is coupled to a predetermined reference potential, and inductively coupling the first transmit signal from the first winding to a second winding of the balun transformer circuit, wherein the second winding of the balun transformer circuit comprises first and second terminals, wherein the first transmit signal at the first and second terminals of the second winding of the balun transformer circuit comprises the differential first transmit signal.

In an Example 18, in any of Examples 11-13 coupling the second transmit signal to the first and second antenna feed ports of the symmetric antenna in an unbalanced coupling configuration comprises coupling a single-ended form of the second transmit signal to a center tap of the second winding of the transformer, wherein the center tap separates the second winding of the transformer into a first portion and a second portion, and wherein a number of turns of the first and second portions are the same. In addition, the coupling results in the second transmit signal being received at the first and second feed ports of the symmetric antenna with a 0° phase difference therebetween.

In an Example 19, an antenna system is disclosed and comprises an antenna comprising first and second antenna feed ports associated therewith, and a hybrid antenna feed circuit coupled to the first and second antenna feed ports of the antenna, wherein the hybrid antenna feed circuit is configured to receive first and second transmit signals and feed the first transmit signal to the first and second antenna feed ports in a balanced feed mode and feed the second transmit signal to the first and second antenna feed ports in an unbalanced mode in a concurrent fashion.

In an Example 20, in Example 19 the hybrid antenna feed circuit is configured to feed the first transmit signal to both the first and second antenna feed ports with a phase difference therebetween of substantially 180° and concurrently feed the second transmit signal to both the first and second antenna feed ports with a phase difference therebetween of substantially 0°.

In an Example 21, in Examples 19 or 20 the hybrid antenna feed circuit comprises a transformer comprising a first winding having first and second terminals and a second winding having first and second terminals, wherein the first and second terminals of the second winding are coupled to the first and second antenna feed ports of the antenna, and wherein the first and second windings of the transformer are inductively coupled to one another. The transformer further comprises a balun transformer comprising a first winding having first and second terminals and a second winding having first and second terminals, wherein the first and second terminals of the second winding of the balun transformer are coupled to the first and second terminals of the first winding of the transformer, wherein a first terminal of the first winding of the balun transformer is coupled to an input port configured to receive the first transmit signal, wherein a second terminal of the first winding of the balun transformer is coupled to a predetermined reference potential, and wherein the first and second windings of the balun transformer are inductively coupled to one another. The second winding of the transformer comprises a center tap coupled to an input port configured to receive the second transmit signal.

In an Example 22, in Example 21 the center tap of the second winding of the transformer separates the second winding into a first portion and a second portion, wherein a number of turns of the first and second portions of the second winding are the same.

In an Example 23, in Examples 19 or 20 the hybrid antenna feed circuit comprises a first input port configured to receive the first transmit signal in a single-ended form, and a first balun inductor coupled between the first input port and the first antenna feed port of the antenna. The hybrid antenna feed circuit further comprises a first balun capacitor coupled between the first antenna feed port of the antenna and a predetermined reference potential, a second balun capacitor coupled between the first input port and the second antenna feed port of the antenna, and a second balun inductor coupled between the second antenna feed port and the predetermined reference potential.

In an Example 24, in Example 23 the hybrid antenna feed circuit further comprises a second input port configured to receive the second transmit signal in a single-ended form, a first inductor coupled between the second input port and the first antenna feed port of the antenna, and a second inductor coupled between the second input port and the second antenna feed port of the antenna.

In an Example 25, in any of Examples 19-22 or 24 the antenna comprises a symmetric antenna comprising a geometry that is spatially symmetric with respect to the first antenna fed port and the second antenna feed port associated therewith.

In an Example 26 an antenna system is disclosed and comprises means for receiving a first transmit signal and a second transmit signal at first and second input ports of the antenna system, means for coupling the first transmit signal received at the first input port to first and second antenna feed ports of an antenna in a balanced coupling configuration using a balanced feed circuit, and means for coupling the second transmit signal received at the second input port to the first and second antenna feed ports of the antenna in an unbalanced coupling configuration using an unbalanced feed circuit. The coupling of the first transmit signal and the second transmit signal to the first and second antenna feed ports is performed concurrently.

In an Example 27, in Example 26 the antenna comprises a symmetric antenna, wherein the symmetric antenna comprises a geometry that is spatially symmetric with respect to the first and second antenna feed ports.

In an Example 28, in Examples 26 or 27 the means for coupling the first transmit signal to the first and second antenna feed ports in a balanced coupling configuration comprises a means for establishing a 180° phase difference in the first transmit signal at the first and second antenna feed ports.

In an Example 29, in any of Examples 26-28 the means for coupling the second transmit signal to the first and second antenna feed ports in an unbalanced coupling configuration comprises a means for establishing a 0° phase difference in the second transmit signal at the first and second antenna feed ports.

In an Example 30, in any of Examples 26-28 the means for coupling the first transmit signal to the first and second antenna feed ports in a balanced coupling configuration comprises means for coupling positive and negative portions of a differential form of the first transmit signal to first and second terminals of a first winding of a transformer, means for inductively coupling the differential first transmit signal from the first winding of the transformer to a second winding of the transformer, the second winding having first and second terminals, and means for coupling the first and second terminals of the second winding of the transformer to the first and second antenna feed ports, respectively, of the symmetric antenna.

In an Example 31, in Example 30 the antenna system further comprises means for receiving the first transmit signal as a single-ended transmit signal, and means for converting the single-ended transmit signal to a differential first transmit signal having the positive and negative portions thereof using a balun transformer circuit.

In an Example 32, in Example 31 the means for converting the single-ended first transmit signal to the differential first transmit signal using the balun transformer circuit comprises means for coupling the single-ended first transmit signal to a first terminal of a first winding of the balun transformer circuit, wherein a second terminal of the first winding of the balun transformer circuit is coupled to a predetermined reference potential, and means for inductively coupling the first transmit signal from the first winding to a second winding of the balun transformer circuit, wherein the second winding of the balun transformer circuit comprises first and second terminals, wherein the first transmit signal at the first and second terminals of the second winding of the balun transformer circuit comprises the differential first transmit signal.

In an Example 33, in any of Examples 26-28 the means for coupling the second transmit signal to the first and second antenna feed ports of the symmetric antenna in an unbalanced coupling configuration comprises means for coupling a single-ended form of the second transmit signal to a center tap of the second winding of the transformer, wherein the center tap separates the second winding of the transformer into a first portion and a second portion, wherein a number of turns of the first and second portions are the same, and wherein the means for coupling results in the second transmit signal being received at the first and second feed ports of the symmetric antenna with a 0° phase difference therebetween.

It should be understood that although various examples are described separately above for purposes of clarity and brevity, various features of the various examples may be combined and all such combinations and permutations of such examples is expressly contemplated as falling within the scope of the present disclosure.

Although the disclosure has been illustrated and described with respect to one or more implementations, alterations and/or modifications may be made to the illustrated examples without departing from the spirit and scope of the appended claims. Furthermore, in particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature of the disclosure may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising".

What is claimed is:

1. An antenna system, comprising:

an antenna comprising a first antenna feed port and a second antenna feed port associated therewith; and an antenna feed circuit comprising:

a balanced feed portion circuit configured to receive a first transmit signal and apply the first transmit signal to the first and second antenna feed ports in a balanced manner; and an unbalanced feed portion circuit configured to receive a second transmit signal and apply the second transmit signal to the first and second antenna feed ports in an unbalanced manner;

wherein the antenna feed circuit is configured to feed the first transmit signal to both the first and second antenna feed ports with a phase difference therebetween of substantially 180° and concurrently feed the second transmit signal to both the first and second antenna feed ports with a phase difference therebetween of substantially 0° wherein the antenna feed circuit comprises a transformer, comprising:

a first winding having a first terminal and a second terminal, wherein the first transmit signal comprises a differential signal having positive and negative signal portions, wherein the positive signal portion of the differential signal couples to the first terminal of the first winding, and the negative signal portion of the differential signal couples to the second terminal of the terminal of the first winding; and a second winding having a first terminal and a second terminal, wherein the first terminal of the second winding is coupled to the first antenna feed port of the antenna, and the second terminal of the second winding is coupled to the second antenna feed port of the antenna, wherein the first winding and the second winding of the transformer are inductively coupled to one another wherein the second transmit signal is a single-ended transmit signal, wherein the second winding of the transformer comprises a center tap separating the second winding into a first portion and a second portion, wherein a number of turns of the first portion and the second portion of the second winding are the same, and wherein the unbalanced feed portion circuit of the antenna feed circuit comprises an input port coupled to the center tap of the second winding, wherein the input port is configured to receive the second transmit signal.

2. An antenna system, comprising:

an antenna comprising a first antenna feed port and a second antenna feed port associated therewith; and an antenna feed circuit comprising:

a balanced feed portion circuit configured to receive a first transmit signal and apply the first transmit signal to the first and second antenna feed ports in a balanced manner; and an unbalanced feed portion circuit configured to receive a second transmit signal and apply the second transmit signal to the first and second antenna feed ports in an unbalanced manner, wherein the antenna feed circuit comprises:

a transformer, comprising:

a first winding having a first terminal and a second terminal; and a second winding having a first terminal and a second terminal, wherein the first terminal of the second winding is coupled to the first antenna feed port of the symmetric antenna ,and the second terminal of the second winding is coupled to the second antenna feed port of the antenna, wherein the first winding and the second winding of the transformer are inductively coupled to one another;

a balun transformer, comprising first and second windings;

wherein the second winding of the balun transformer comprises a first terminal coupled to the first terminal of the first winding of the transformer, and a second terminal coupled to the second terminal of the first winding of the transformer;

wherein the first winding of the balun transformer comprises a first terminal coupled to an input port configured to receive the first transmit signal, and a second terminal coupled to a predetermined reference potential, wherein the first transmit signal comprises a single-ended signal;

wherein the second transmit signal is a single-ended transmit signal, wherein the second winding of the transformer comprises a center tap separating the second winding into a first portion and a second portion, wherein a number of turns of the first portion and the second portion of the second winding are the same, and wherein the unbalanced feed portion circuit of the antenna feed circuit comprises an input port coupled to the center tap of the second winding, wherein the input port is configured to receive the second transmit signal.

3. A method of operating an antenna system, comprising:

receiving a first transmit signal and a second transmit signal at first and second input ports of the antenna system;

coupling the first transmit signal received at the first input port to first and second antenna feed ports of a symmetric antenna in a balanced coupling configuration using a balanced feed circuit;

coupling the second transmit signal received at the second input port to the first and second antenna feed ports of the symmetric antenna in an unbalanced coupling configuration using an unbalanced feed circuit;

receiving the first transmit signal as a single-ended transmit signal; and converting the single-ended transmit signal to a differential first transmit signal having the positive and negative portions thereof using a balun transformer circuit;

wherein the symmetric antenna comprises a geometry that is spatially symmetric with respect to the first and second antenna feed ports, and wherein the coupling of the first transmit signal and the second transmit signal to the first and second antenna feed ports is performed concurrently wherein coupling the first transmit signal to the first and second antenna feed ports in a balanced coupling configuration comprises:

coupling positive and negative portions of a differential form of the first transmit signal to first and second terminals of a first winding of a transformer;

inductively coupling the differential first transmit signal from the first winding of the transformer to a second winding of the transformer, the second winding having first and second terminals; and coupling the first and second terminals of the second winding of the transformer to the first and second antenna feed ports, respectively, of the symmetric antenna, wherein converting the single-ended first transmit signal to the differential first transmit signal using the balun transformer circuit comprises:

coupling the single-ended first transmit signal to a first terminal of a first winding of the balun transformer circuit, wherein a second terminal of the first winding of the balun transformer circuit is coupled to a predetermined reference potential; and inductively coupling the first transmit signal from the first winding to a second winding of the balun transformer circuit, wherein the second winding of the balun transformer circuit comprises first and second terminals, wherein the first transmit signal at the first and second terminals of the second winding of the balun transformer circuit comprises the differential first transmit signal.

4. An antenna system, comprising:

an antenna comprising first and second antenna feed ports associated therewith; and a hybrid antenna feed circuit coupled to the first and second antenna feed ports of the antenna, wherein the hybrid antenna feed circuit is configured to receive first and second transmit signals and feed the first transmit signal to the first and second antenna feed ports in a balanced feed mode and feed the second transmit signal to the first and second antenna feed ports in an unbalanced mode in a concurrent fashion;

wherein the hybrid antenna feed circuit is configured to feed the first transmit signal to both the first and second antenna feed ports with a phase difference therebetween of substantially 180° and concurrently feed the second transmit signal to both the first and second antenna feed ports with a phase difference therebetween of substantially 0° ;

wherein the hybrid antenna feed circuit comprises:

a transformer comprising a first winding having first and second terminals and a second winding having first and second terminals, wherein the first and second terminals of the second winding are coupled to the first and second antenna feed ports of the antenna, and wherein the first and second windings of the transformer are inductively coupled to one another; and a balun transformer comprising a first winding having first and second terminals and a second winding having first and second terminals, wherein the first and second terminals of the second winding of the balun transformer are coupled to the first and second terminals of the first winding of the transformer, wherein a first terminal of the first winding of the balun transformer is coupled to an input port configured to receive the first transmit signal, wherein a second terminal of the first winding of the balun transformer is coupled to a predetermined reference potential, and wherein the first and second windings of the balun transformer are inductively coupled to one another;

wherein the second winding of the transformer comprises a center tap coupled to an input port configured to receive the second transmit signal.

5. The antenna system of claim 4, wherein the center tap of the second winding of the transformer separates the second winding into a first portion and a second portion, wherein a number of turns of the first and second portions of the second winding are the same.

6. The antenna system of claim 5, wherein the hybrid antenna feed circuit comprises:

a first input port configured to receive the first transmit signal in a single-ended form;

a first balun inductor coupled between the first input port and the first antenna feed port of the antenna;

a first balun capacitor coupled between the first antenna feed port of the antenna and a predetermined reference potential;

a second balun capacitor coupled between the first input port and the second antenna feed port of the antenna; and a second balun inductor coupled between the second antenna feed port and the predetermined reference potential.

7. The antenna system of claim 6, wherein the hybrid antenna feed circuit further comprises:

a second input port configured to receive the second transmit signal in a single-ended form;

a first inductor coupled between the second input port and the first antenna feed port of the antenna; and a second inductor coupled between the second input port and the second antenna feed port of the antenna.

* * * * *